US006719814B1

(12) United States Patent
Lin

(10) Patent No.: US 6,719,814 B1
(45) Date of Patent: Apr. 13, 2004

(54) LUBRICITY ADDITIVE, PROCESS FOR PREPARING LUBRICITY ADDITIVES, AND MIDDLE DISTILLATE FUEL COMPOSITIONS CONTAINING THE SAME

(75) Inventor: Jian Lin, Reading (GB)

(73) Assignee: Infineum International LTD (GB)

( * ) Notice: Subject to any disclaimer, the term of this patent is extended or adjusted under 35 U.S.C. 154(b) by 0 days.

(21) Appl. No.: 09/428,972

(22) Filed: Nov. 4, 1999

(51) Int. Cl.[7] ..... C10L 1/18
(52) U.S. Cl. ..... 44/398; 560/67
(58) Field of Search ..... 44/389, 398; 560/67

(56) References Cited

U.S. PATENT DOCUMENTS

| | | | | | |
|---|---|---|---|---|---|
| 4,098,708 | A | * | 7/1978 | Stuebe | 560/67 |
| 4,609,376 | A | * | 9/1986 | Craig et al. | 44/389 |
| 5,855,628 | A | * | 1/1999 | Hashimoto et al. | 44/306 |

FOREIGN PATENT DOCUMENTS

| | | | |
|---|---|---|---|
| EP | 000147240 | * | 7/1985 |
| WO | 009801516 | * | 1/1998 |
| WO | 009816596 | * | 4/1998 |

* cited by examiner

*Primary Examiner*—Margaret Medley

(57) ABSTRACT

The invention provides a lubricity additive in the form of an ester of an acid and an alcohol, wherein the acid is an aromatic mono-, di- or polyhydric, mono-, di- or polycarboxylic acid or mixture thereof, which may be alkylated and/or alkoxylated and wherein the alkyl and/or alkoxy groups, if any, are independently selected from groups having from 1 to 30 carbon atoms, characterised in that (a) the alcohol is glycerol, and (b) the mole percent of acid groups in the lubricity additive is less than 10%, based on the total of acid and ester groups. The invention also provides a process for preparing the lubricity additive, and a middle distillate fuel oil having a sulphur concentration of 0.2% by weight or less, and a minor portion of the lubricity additive.

2 Claims, No Drawings

LUBRICITY ADDITIVE, PROCESS FOR PREPARING LUBRICITY ADDITIVES, AND MIDDLE DISTILLATE FUEL COMPOSITIONS CONTAINING THE SAME

FIELD OF THE INVENTION

This invention relates to a lubricity additive, a process for preparing lubricity additives, and low-sulphur, middle distillate fuel oil compositions containing the same.

BACKGROUND OF THE INVENTION

International application WO 98/01516 concerns acids have excellent lubricity behaviour when used in a fuel oil composition comprising a major amount of a low-sulphur, middle distillate fuel oil.

International application WO 98/16596 concerns specific substituted aromatic ester compounds useful as lubricity additive for middle distillate fuel compositions comprising a major proportion of a diesel fuel oil having a sulphur concentration of 0.2% by weight or less, and a minor proportion of the additive. The specific substituted aromatic ester compounds are produced by esterification of an acid similar to those of WO 98/01516 with a mono- or polyhydroxy alcohol. Typical examples are based on the esterification of a $C_{18}$-alkyl salicylic acid with ethylene glycol (conversion of the acid to the ester product up to a degree of 45%), or by an epoxy ring-opening reaction using glycidol (conversion up to 80.4%).

It would be desirable if lubricity additives could be found with even better properties.

SUMMARY OF THE INVENTION

Accordingly, the invention provides a lubricity additive in the form of an ester of an acid and an alcohol, wherein the acid is an aromatic mono-, di- or polyhydric, mono-, di- or polycarboxylic acid or mixture thereof, which may be alkylated and/or alkoxylated and wherein the alkyl and/or alkoxy groups, if any, are independently selected from groups having from 1 to 30 carbon atoms, characterised in that (a) the alcohol is glycerol, and (b) the mole percent of acid groups in the lubricity additive is less than 10%, based on the total of acid and ester groups. Preferably the mole percent of acid groups in the lubricity additive is less than 5%.

The invention also provides a process for preparing the lubricity additive characterised in that (a) the alcohol is glycerol, and (b) the esterification is carried out in the presence of catalyst selected from boric acid or a titanium alkoxide.

The invention also provides a middle distillate fuel oil having a sulphur concentration of 0.2% by weight or less, and a minor portion of the lubricity additive.

DETAILED DESCRIPTION OF THE INVENTION

The lubricity additives according to the present invention have been produced by esterification, wherein the degree of esterification is at least 90%, preferably at least 95%, and more preferably at least 97%, by weight of the original amount of acid or derivative reactant acid. These esters may also be identified by their residual acid value, provided the (average) molecular weight of the acid is known. For instance, if the lubricity additive is produced from a mixture of acids having an average molecular weight of 400 with a corresponding acid value of 2.5 mmole/g, then the lubricity additive will have a residual acid value of less than 0.25 mmole/g.

The lubricity additives therefore differ from those of WO 98/16596 in that their residual acid values are substantially lower, and in the selection of glycerol as alcohol feed. Given the already outstanding performance of the acids and the—slightly—underscoring performance of the glycidol ester D in WO 98/16596 vis-à-vis the—more acid containing—glycol esters A, B and C in WO 98/16596, a further improvement for the lubricity additives of the present invention could not be expected.

The acid, the ester, the process and the fuel composition will now be discussed in further detail.

The Acid

The acid from which the ester is derived may be an aromatic mono-, di- or polyhydric, mono-, di- or polycarboxylic acid wherein the carboxyl and hydroxyl groups are attached to the aromatic nucleus. The aromatic nucleus may be monocyclic, bicyclic or polycyclic, e.g., a benzene ring or a naphthalene ring. Besides, the aromatic nucleus may be contain heterogeneous elements, e.g., nitrogen and oxygen atoms. The aromatic nucleus is preferably a benzene ring. The presence of at least one hydroxyl group (in contrast to esters based on benzoic acid) has been found essential. More than 1 hydroxyl group may be present, but the presence of one hydroxyl group is preferred. Similarly, the presence of one arboxyl group—rather than 2 or more—is preferred.

The aromatic nucleus may be substituted with one or more groups selected independently from alkyl and alkoxy groups of 1 to 30 carbon atoms. Preferred acids are those in which whenever there are less than three groups selected from alkyl and alkoxy groups attached to the aromatic nucleus, there is at least one group selected from alkyl and alkoxy groups of 2 to 30 carbon atoms attached to said nucleus. Preferably, the acid is an alkyl salicylic acid containing one or two alkyl groups of 1—30 carbon atoms. The or each alkyl or alkoxy group in the acid has preferably 8 to 22 carbon atoms, more preferably 8 to 18 carbon atoms.

The acids from which the ester is derived are either known compounds or can be prepared by methods analogous to methods used for preparing known compounds, as will readily be appreciated by those skilled in the art.

Preferred alkyl salicylic acids may be very readily be prepared by the methods described in UK 1146925. (In that patent, the alkyl salicylic acids are intermediates in the preparation of polyvalent metal salts used as dispersants in lubricant compositions).

The Ester

The ester is prepared by esterifying the acid directly with the alcohol in the presence of a catalyst and distilling off the water formed.

The Process

The preparation of esters of an aromatic acid via direct esterification is known to those skilled in the art. For instance, Romanian patent RO 0102886 and U.S. Pat. No. 4,098,708 describe processes using p-toluenesulphonic acid as catalyst; RO 093627 describes processes using sulphuric acid as catalyst; French patent FR 2200241 describes processes using p-toluenesulphonic acid or sulphuric acid as catalyst; Russian Journal Maslo-zhir. Prom-st, (1986), (8), 25–6, J. Chem. Educ., (1996), 73(2), 173–5 and Chinese patent CN 1056488 describe processes using boric acid as catalyst; Indian patent 167688 describes processes using molecular sieve as catalyst. Also, WO 98/16596 describes methods of making esters from salicylic acid and polyols.

There is no indication in any of the above documents what process and/or catalyst might be used in order to produce lubricity additives that outperform those of WO 98/16596.

In the present invention, we have found that processes using boric acid or titanium alkoxides as catalyst and glycerol as alcohol reactant lead to the highest conversion of the acid to ester, typically as high as 99.9%.

Preferred titanium alkoxides are based on alkoxy groups having 1 to 10 carbon atoms, preferably based on alkoxy groups having 2 to 6 carbon atoms. A suitable titanium alkoxide is, for instance, titanium(IV) butoxide.

The process is ordinarily carried out at temperatures 30 of from 50 to 250° C. The process is preferably carried out at temperatures of from 100 to 250° C. and especially of from 125 to 250° C.

The reaction may be carried out with or without a diluent. Typically it is carried out in the presence of an inert, non-polar liquid organic diluent, for example, hydrocarbons such as naphtha, mineral oil, toluene, xylene (ortho-, meta-, para- or a mixture thereof).

The ratio of OH equivalent of glycerol over COOH equivalent of acid will at least be 1, typically ranging from 1 to 10, preferably from 1 to 5.

The low-sulphur, Middle Distillate Fuel Oil Composition

Fuel oil compositions in accordance with the invention may be prepared by a process which comprises admixing the additive or an additive concentrate containing the additive with the fuel oil.

The ester is preferably present in an amount in the range 50 to 600 ppmw, more preferably 50 to 500 ppmw, most preferably 150 to 300 ppmw ("ppmw" is parts per million by weight), based on the total weight of the fuel composition. Also mixtures of esters may be used.

The middle distillate fuel oil may be derived from petroleum or from vegetal sources or a mixture thereof.

It will having a boiling range in the range 100° C. to 500° C., e.g. 150° C. to 400° C. Petroleum-derived fuel oils may comprise atmospheric distillate or vacuum distillate, or cracked gas oil or a blend in any proportion of straight run and thermally and/or catalytically cracked distillates. Fuel oils include kerosene, jet fuels, diesel fuels, heating oils and heavy fuel oils. Preferably the fuel oil is a diesel oil, and preferred fuel oil compositions of the invention are thus diesel fuel compositions. Diesel fuels typically have initial distillation temperature about 160° C. and final distillation temperature of 290–360° C., depending on fuel grade and use.

A fuel oil, e.g. diesel oil, itself may be an additised (additive-containing) oil or an unadditised (additive-free) oil. If the fuel oil, e.g. diesel oil, is an additised oil, it will contain minor amounts of one or more additives, e.g. one or more additives selected from anti-static agents, pipeline drag reducers, flow improvers (e.g. ethylene/vinyl acetate copolymers or acrylate/maleic anhydride copolymers) and wax anti-settling agents (e.g. those commercially available under the Trade Marks "PARAFLOW" (e.g., "PARAFLOW" 450; ex Paramins), "OCTEL" (e.g., "OCTEL" W 5000; ex Octel) and "DODIFLOW" (e.g., "DODIFLOW" v 3958; ex Hoechst).

Preferably the fuel oil is a middle distillate oil, e.g. a diesel oil, having a sulphur content of at most 0.2% by weight (2000 ppmw), more preferably at most 0.05% by weight (500 ppmw). Advantageous compositions of the invention are also attained when the sulphur content of the fuel oil is below 0.005% by weight (50 ppmw) or even below 0.001% by weight (10 ppmw).

Fuel oil compositions in accordance with the invention may be prepared by a process for their preparation which comprises admixing the additive or an additive concentrate containing the additive with the fuel oil.

Additive concentrates suitable for incorporating in the fuel oil compositions (preferably diesel fuel compositions) will contain the additive and may contain a fuel-compatible diluent, which may be a carrier oil (e.g. a mineral oil), a polyether, which may be capped or uncapped, a non-polar solvent such as toluene, xylene, white spirits and those sold by member companies of the Royal Dutch/Shell Group under the Trade Mark "SHELLSOL", and/or a polar solvent such as esters and, in particular, alcohols, e.g. hexanol, 2-ethylhexanol, decanol, isotridecanol and alcohol mixtures such as those sold by member companies of the Royal Dutch/Shell Group under the Trade Mark "LINEVOL", especially "LINEVOL" 79 alcohol which is a mixture of $C_{79}$ primary alcohols, or the $C_{12-14}$ alcohol mixture commercially available from Sidobre Sinnova, France under the Trade Mark "SIPOL".

Additive concentrates and fuel oil compositions prepared therefrom may further contain additional additives such as ashless detergents or dispersants, e.g. linear or branched hydrocarbyl amines, for example alkylamines, hydrocarbyl-substituted succinimides, such as those described in EP-A-147 240, preferably the reaction product of a polyisobutylene succinic acid or anhydride with tetraethylene pentamine wherein the polyisobutylene substituent has a number average molecular weight (Mn) in the range 500 to 1200, and/or an alkoxy acetic acid derivative as described in International application WO 97/41092; dehazers, e.g. alkoxylated phenol formaldehyde polymers such as those commercially available as "NALCO" (Trade Mark) EC5462A (formerly 7D07) (ex Nalco), and "TOLAD" (Trade Mark) 2683 (ex Petrolite); anti-foaming agents (e.g. the polyether-modified polysiloxanes commercially available as "TEGOPREN" (Trade Mark) 5851, Q 25907 (ex Dow Corning) or "RHODORSIL" (ex Rhone Poulenc)); ignition improvers (e.g. 2-ethylhexyl nitrate, cyclohexyl nitrate, di-tertiarybutyl peroxide and those disclosed in U.S. Pat. No. 4,208,190 at Column 2, line 27 to Column 3, line 21); anti-rust agents (e.g. that commercially sold by Rhein Chemie, Mannheim, Germany as "RC 4801", or polyhydric alcohol esters of a succinic acid derivative, the succinic acid derivative having on at least one of its alpha-carbon atoms an unsubstituted or substituted aliphatic hydrocarbon group containing from 20 to 500 carbon atoms, e.g. the pentaerythritol diester of polyisobutylene-substituted succinic acid), reodorants, anti-wear additives; anti-oxidants (e.g. phenolics such as 2,6-di-tert-butylphenol, or phenylenediamines such as N,N'-di-sec-butyl-p-phenylenediamine); and metal deactivators.

Unless otherwise stated, the (active matter) concentration of each additional additive in the diesel fuel is preferably up to 1 percent by weight, more preferably in the range from 5 to 1000 ppmw (parts per million by weight of the diesel fuel). The (active matter) concentration of the detergent or dispersant in the diesel fuel is preferably 30 to 1000 ppmw, more preferably 50 to 600 ppmw, advantageously 75 to 300 ppmw e.g. 95 to 150 ppmw.

The (active matter) concentration of the dehazer in he diesel fuel is preferably in the range from 1 to 20 ppmw, more preferably from 1 to 15 ppmw, still more preferably from 1 to 10 ppmw and advantageously from 1 to 5 ppmw. The (active matter) concentrations of other additives (with the exception of the ignition improver are each preferably in the range from 0 to 20 ppmw, more preferably from 0 to 10 ppmw. The (active matter) concentration of the ignition improver in the diesel fuel is preferably in the range from 0 to 600 ppmw and more preferably from 0 to 500 ppmw. If an ignition improver is incorporated into the diesel fuel, it may conveniently be used in an amount of 300 to 500 ppmw.

The invention further provides the use of a fuel composition as defined above as fuel in a compression-ignition engine for controlling wear rate in the fuel injection system of the engine, especially in fuel injection pumps and/or fuel injectors.

This latter aspect of the invention may also be expressed as a method of operating a compression-ignition engine which comprises providing a fuel composition as defined above as the fuel in the engine thereby to control wear rate in the fuel injection system of the engine, especially the fuel injection pump and/or fuel injectors.

The invention will be further understood from the following illustrative examples, in which the acid value was determined using a "METROHM 670" (Trade Mark) potentiometric titrometer according to a method based on ASTM D 664–89 with a modified solvent system (the product is first dissolved in a toluene/methyl ethyl ketone 60/40 weight/weight mixture, and then diluted with a tert-butanol/water toluene 38.8/2.9/58.2 weight/weight/weight mixture), and in which the base fuels and additive components were as follows:

| | Fuel 1 |
|---|---|
| Density (kg/l) at 15° C. (ASTM D 4052) | 0.8165 |
| Sulphur (ppmw) (IP 373) | <5 |
| Distillation, degrees C. (ASTM D 86) | |
| Initial Boiling Point | 184.5 |
| 10% | 206.5 |
| 20% | 213.5 |
| 50% | 235.5 |
| 90% | 268.5 |
| 95% | 277.5 |
| Final Boiling Point | 290 |
| Total Aromatics content (% w) | 3.8 |

"Alkyl salicylic acid"

Was prepared from $C_{14-18}$ alkyphenol by phenation, carboxylation and hydrolysis, as described in UK 1146925. The starting alkylphenol was prepared from a mixture of olefins ($C_{14}$:$C_{16}$:$C_{18}$ weight ratio 1:2:1), by reacting phenol and the olefins (molar ratio 5:1) in the presence of 3% w, based on the olefins, of acid-activated montmorillonite catalyst at 190° C. and 40 KPa pressure, with excess phenol being removed by distillation. The end-product $C_{14-18}$ alkyl salicylic acid typically contained about 72% mole monoalkyl salicylic acid, 17% mole monoalkyl phenol, and 5% mole dialkylphenol, the balance being minor quantities of 4-hydroxyisophthalic acid, dialkyl salicylic acid, 2-hydroxyisophthalic acid and alkyl phenyl ether. Small variations are found per batch, and different batches were used in the Examples.

EXAMPLES 1

30g (0.074 mole) of alkyl salicylic acid, 6.8 g (0.074 mole) of glycerol, 2.3 g (0.037 mole) of boric acid and 150 ml of xylene were heated to reflux (about 140° C.) under nitrogen for 6 hrs and water formed was removed via a Dean-Stark trap. An additional 0.5 g (0.008 mole) of boric acid were added and reflux continued for further 5 hrs. The mixture was then filtered through "CELITE" (Trade Mark) filter aid, and evaporated under reduced pressure to give 21 g of a dark brown liquid. GPC analysis (using polystyrene standards) gave a Mn of 1194 and a polydispersity of 1.3; acid value: 0.0024 meq/g (99.9% conversion of alkyl salicylic acid); IR: 1680 $cm^{-1}$.

EXAMPLE 2

2500 g (3.475 mole) of alkyl salicylic acid in xylene (acid value 1.39 meq/g), 319.7 g (3.475 mole) of glycerol, and 50.3g (0.128 mole) of titanium(IV) butoxide were heated to reflux under nitrogen for 14.5 hrs and water formed was removed via a Dean-Stark trap. The mixture was cooled and then filtered through "CELITE" (Trade Mark) filter aid and evaporated under reduced pressure to give 1572 g of an orangy brown viscous liquid. The acid value as found to be 0.0019 meq/g (98.7% conversion of alkyl alicylic acid); IR: 1677 $cm^{-1}$.

COMPARATIVE EXAMPLE 3

32 g (0.072 mole) of alkyl salicylic acid, 9.76 g (0.072 mole) of pentaerythritol and 2.2 g (0.036 mole) of boric acid were heated to 200° C. under nitrogen for 5 hrs. The reaction mixture was cooled and toluene added, and the mixture filtered to remove the white solid. The filtrate was evaporated under vacuum to give 31 g of product (acid value: 0.60 meq/g; 73% conversion of alkyl salicylic acid); This crude product was re-dissolved in toluene, washed once with 4M sodium hydroxide solution, twice with water and once with brine. The solution was dried over magnesium sulphate, filtered through "CELITE" (Trade Mark) filter aid and evaporated to give 29.5 g of a brown oil (acid value: 0). GPC analysis (using polystyrene standards) gave a Mn of 681 and a polydispersity of 1.3; IR: 1677 $cm^{-1}$.

Using the method described in Example 1 of US4098708 an ester derivative of alkyl salicylic acid with pentaerythritol with nearly identical results (also on lubricity performance) was obtained. {acid value of 0.4 meq/g}.

COMPARATIVE EXAMPLE 4

20 g (0.045 mole) of alkyl salicylic acid, 2.78 g (0.045 mole) of ethylene glycol, 1.38 g (0.022 mole) of boric acid and 50ml of xylene were heated to reflux under nitrogen for 16 hrs. The water formed was removed via a Dean and Stark trap. The mixture was dissolved in excess toluene, filtered through "CELITE" (Trade Mark) filter aid and evaporated to give 20.3 g of crude product. This as re-dissolved in toluene, washed once with 4M sodium hydroxide solution, twice with water and twice with brine. The solution was dried over magnesium sulphate, filtered through "CELITE" (Trade Mark) filter aid and evaporated to give 17.2 g of a brown oil. GPC analysis (using polystyrene standards) gave a Mn of 520 and a polydispersity of 1.4; acid value: 0.22 meq/g (90% conversion of alkyl salicylic acid); IR: 1678 $cm^{-1}$.

COMPARATIVE EXAMPLE 5

25 g (0.069 mole) of alkyl salicylic acid, 63 g (0.69 mole) of glycerol and 1.2 g of p-toluenesulphonic acid in 200 ml of xylene were heated to reflux overnight with a Dean-Stark water trap. A black gum formed without ester formation by IR.

COMPARATIVE EXAMPLE 6

61.6 g (0.0866 mole) of a 60% xylene solution of alkyl salicylic acid, 7.98 g (0.0866 mole) of glycerol and 5 g of Amberlyst 15 were heated to reflux overnight under nitrogen with a Dean-Stark water trap. The mixture was filtered, dried over magnesium sulphate, filtered through "CELITE" (Trade Mark) filter aid, solvent evaporated to give a dark brown oil. Acid value: 1.58 meq/g; IR indicates presence of both ester and acid: 1678, 1660 $cm^{-1}$.

COMPARATIVE EXAMPLE 7

66 g (0.0937 mole) of a 60% xylene solution of alkyl salicylic acid, 8.63 g (0.0937 mole) of glycerol and 1g of DOWEX 50WX2-100 were heated to reflux for 28 hrs under nitrogen with a Dean-Stark water trap. The mixture was filtered, dried over magnesium sulphate, filtered through "CELITE" (Trade Mark) filter aid, solvent evaporated to give a dark brown oil. Acid value: 1.84 meq/g; IR indicates presence of both ester and acid: 1678, 1660 $cm^{-1}$.

COMPARATIVE EXAMPLE 8

11 g (0.062 mole) of 4-n-butylbenzoic acid, 5.68 g (0.062 mole) of glycerol and 2.36 g (0.038 mole) of boric acid were heated to 200° C. under nitrogen for 3 hrs. After cooling, 9.56 g of a clear light brown solid was produced. The crude product was dissolved in dichloromethane, washed once with 4M sodium hydroxide solution, twice with water and once with brine. The solution was dried over magnesium sulphate, filtered through "CELITE" (Trade Mark) filter aid and evaporated to give 4.22 g of a pale yellow oil. GPC analysis (using polystyrene standards) gave a Mn of 646 and a polydispersity of 1.1; acid value: 0.032 meq/g; IR: 1723 $cm^{-1}$.

Comments on Processes

When comparing comparative examples 3 and 4 with examples 1 and 2, the much higher esterification degree is noticed in examples 1 and 2. Replacing these catalysts with other catalysts (e.g., known from WO 98/16596) as shown in comparative examples 5 to 8 did not improve the degree of esterification. Using other catalysts such as concentrated sulphuric acid, ferric chloride, Montmorillonite K10 (not included in the specification) did not lead to ester formation at all, or lead to high residual acid values (as in the case of zinc chloride, AMBERLYST 15, or DOWEX 50WX2-100, also not shown).

Performance as Llubricity Additives For Low Sulphur Diesel HFRR testing was carried out according to the procedure of CEC F-06-T-96 (the volume of the fuel used was 2 ml and the fluid temperature was 60°C.). Thus, diesel fuels were prepared by adding quantities of a number of different esters to Base Fuel 1 to concentrations of 200 and 300 ppmw. The resulting fuels were tested for lubricity performance and the results are given in Table 1.

TABLE 1

HFRR results

| Fuel example | Concentration of additive in fuel (ppmw) | Average wear scar diameter (microns) |
|---|---|---|
| Comparative A | 0 | 622 |
| Example 1 | 200 | 346 |
| Example 1 | 300 | 274 |
| Example 2 | 300 | 214 |
| Ester A of WO 98/16596 | 300 | 310 |
| Example 19 of WO 98/01516 | 200 | 387 |
| Example 20 of WO 98/01516 | 200 | 352 |
| Comparative Example 3 | 300 | 444 |
| Comparative Example 4 | 300 | 370 |

It will be noted that low sulphur diesel compositions containing test materials of present invention give surprisingly enhanced lubricity. The glycol and pentaerythritol esters, on the other hand performed much less.

What is claimed is:

1. A fuel oil composition comprising a major amount of a middle distillate fuel oil having a sulphur concentration of 0.001% by weight or less and 50–600 ppmw of a lubricity additive in the form of an ester of an acid and an alcohol, wherein the acid is an alkyl salicylic acid having 1 or 2 alkyl groups each having 8 to 18 carbon atoms, characterised in that (a) the alcohol is glycerol, and (b) the degree of esterification of the ester is at least 97% based on the original weight of acid.

2. The composition of claim 1 wherein there is present 150–300 ppmw of the lubricity additive.

* * * * *